US007516829B2

(12) United States Patent
Ishida

(10) Patent No.: US 7,516,829 B2
(45) Date of Patent: Apr. 14, 2009

(54) VENDING MACHINE OF ENCAPSULATED ARTICLE OF COMMERCE

(75) Inventor: Shoichi Ishida, Shinjuku-ku (JP)

(73) Assignee: Kite International Co., Ltd., Tokyo (JP)

( * ) Notice: Subject to any disclaimer, the term of this patent is extended or adjusted under 35 U.S.C. 154(b) by 850 days.

(21) Appl. No.: 10/512,254

(22) PCT Filed: Jul. 23, 2002

(86) PCT No.: PCT/JP02/07458

§ 371 (c)(1),
(2), (4) Date: Oct. 21, 2004

(87) PCT Pub. No.: WO03/091957

PCT Pub. Date: Nov. 6, 2003

(65) Prior Publication Data

US 2005/0178790 A1 Aug. 18, 2005

(30) Foreign Application Priority Data

Apr. 25, 2002 (JP) ..... 2002-123513

(51) Int. Cl.
*G07F 7/04* (2006.01)

(52) U.S. Cl. ..... 194/206; 194/219; 194/223; 194/230; 221/7; 700/236; 377/7

(58) Field of Classification Search ..... 194/202, 194/206, 207, 219–223, 230, 231, 235–245, 194/255, 292; 209/534; 221/7; 453/32; 700/236, 241, 244; 377/7
See application file for complete search history.

(56) References Cited

U.S. PATENT DOCUMENTS

| | | | | |
|---|---|---|---|---|
| 4,940,162 | A | 7/1990 | Thie | |
| 5,725,081 | A * | 3/1998 | Meeker | 194/206 |
| 5,909,795 | A * | 6/1999 | Porco et al. | 194/243 |
| 5,947,328 | A * | 9/1999 | Kovens et al. | 221/129 |
| 6,050,447 | A * | 4/2000 | Kovens et al. | 221/125 |

* cited by examiner

*Primary Examiner*—Jeffrey A Shapiro
(74) *Attorney, Agent, or Firm*—Howson & Howson LLP

(57) ABSTRACT

It is an object of the invention to provide a bill-operated capsuled article vending machine. The capsuled article vending machine 10 is provided with a capsule container 12 at an upper portion thereof and a capsule dispensing unit 14 at a lower portion thereof. The capsule dispensing unit 14 is provided with a reverse rotation preventing mechanism 44 of the handle 32, a bill identifying unit 50, a bill storing box 52 and a rotation control unit 54 for the handle 32, in addition to the handle 32. The rotation control unit 54 is provided with a locking mechanism 60 for locking or unlocking the handle 32, a sensor 62 for detecting a rotational position or a rotational angle of the handle 32 and a control unit 64. When the bill identifying unit 50 recognizes reception of a prescribed bill, the rotation control unit 54 enables one rotation of the handle 32, by which an article is dispensed.

2 Claims, 9 Drawing Sheets

VENDING MACHINE OF ENCAPSULATED ARTICLE OF COMMERCE

BACKGROUND OF THE INVENTION

1. Field of the Invention

The present invention relates to a capsuled article vending machine for selling a commodity such as a toy enclosed in a spherical capsule.

2. Description of the Related Art

A capsuled article vending machine is targeted mainly at juveniles. Accordingly it is designed for inserting a coin and dispensing an article enclosed in a capsule in exchange for the coin. Such capsuled article vending machine is provided with a capsule container at an upper portion thereof and a capsule dispensing unit at a lower portion thereof.

A purchaser inserts a coin and then rotates a handle. The capsuled article vending machine lets the purchaser rotate the handle only once with a clicking sound, and dispenses an article enclosed in a capsule when the rotating action is completed. Through such procedure, the capsuled article vending machine gives the purchaser an expectative sensation on which of those articles shown in the capsule container will be delivered. On the part of the purchaser, he or she expands the expectation with an auditory stimulation by the clicking sound under an actual feeling of operating the machine by his/her own hand.

However a conventional capsuled article vending machine is designed for selling an inexpensive article since its main target is young people. Therefore it is not suitable for selling an expensive article.

It might be possible to sell an expensive article, by setting the vending machine to receive a plurality of coins. However it is troublesome for a purchaser to insert a plurality of coins. In addition, the capsuled article vending machine has to have a more complicated structure in order to receive a plurality of coins.

Accordingly, it is an object of the invention to provide a capsuled article vending machine to be operated by insertion of a monetary bill.

It is another object of the invention to provide a capsuled article vending machine to be operated by insertion of a monetary bill, maintaining the function for producing auditory stimulation, which is an advantage of the coin-operated capsuled article vending machine.

It is still another object of the invention to provide a capsuled article vending machine to be operated by insertion of a monetary bill, maintaining the function of producing tactile feeling from operating the machine the purchase him/herself.

It is still another object of the invention to provide a capsuled article vending machine to be operated by insertion of a monetary bill that can prevent an erroneous dispensing operation that may be caused by a purchaser's article dispensing operation.

SUMMARY OF THE INVENTION

The present invention achieves the foregoing object by providing a capsuled article vending machine having a capsule container and a capsule dispensing unit for dispensing a capsule out of the capsule container through the capsule dispensing unit each time a handle is rotated by one rotation, comprising a bill identifying unit for identifying a monetary bill; a bill storing box located at a downstream side of the bill identifying unit; and a rotation control unit for enabling one rotation of the handle after a bill is identified by the bill identifying unit.

According to the capsuled article vending machine of the invention, since the rotation control unit enables one rotation of the handle upon acceptance of a bill through the bill identifying unit, a more expensive article can be sold than by a conventional capsuled article vending machine. Consequently, expensive merchandise over an extensive variety can be sold through the capsuled article vending machine of the invention.

According to the invention, since the rotation control unit enables one rotation of the handle upon acceptance of a bill through the bill identifying unit, a more expensive article can be sold than by a conventional capsuled article vending machine. Consequently, expensive merchandise over an extensive variety can be sold through the capsuled article vending machine of the invention.

The invention provides a capsuled article vending machine having a capsule container and a capsule dispensing unit for dispensing a capsule out of the capsule container through the capsule dispensing unit each time a handle is rotated by one rotation, comprising therein a reverse rotation preventing mechanism of the handle; a bill identifying unit for identifying a monetary bill; and a rotation control unit for enabling one rotation of the handle after a bill is identified by the bill identifying unit; wherein the rotation control unit is provided with a locking mechanism of the handle, a sensor for detecting rotational motion of the handle, and a control unit for locking or unlocking the locking mechanism according to operation of the sensor.

According to such capsuled article vending machine, the reverse rotation preventing mechanism prevents the handle from rotating in a reverse direction and the rotation control unit enables one forward rotation of the handle upon acceptance of a bill through the bill identifying unit. And since the bill identifying unit for accepting a bill, the reverse rotation preventing mechanism of the handle and the rotation control unit are contained inside the capsuled article vending machine for selling an article in exchange with a bill, expensive merchandise over an extensive variety can be sold without modifying an outer appearance of a conventional capsuled article vending machine.

Unlike a conventional vending machine that enables one rotation of the handle by insertion of a coin, the capsuled article vending machine according to the invention is, because of being a bill-operated vending machine, provided with a locking mechanism of the handle, a sensor for detecting rotational motion of the handle and a control unit for locking or unlocking the locking mechanism according to operation of the sensor, in order to enable one rotation of the handle. As a result of such constitution, one rotation of the handle can be activated in relation with the bill identifying unit.

According to another aspect of the invention, the reverse rotation preventing mechanism is provided with ratchet teeth that rotates in synchronization with the handle and a ratchet engaged with the ratchet teeth for preventing a reverse rotation of the handle, so that vibration is propagated to the handle and an impact sound is produced each time the ratchet passes over each of the ratchet teeth. Since the reverse rotation preventing mechanism is provided with ratchet teeth that rotates in synchronization with the handle and a ratchet engaged with the ratchet teeth for preventing a reverse rotation of the handle, so that vibration is propagated to the handle and an impact sound is produced each time the ratchet passes over each of the ratchet teeth, the capsuled article vending machine according to the invention, constituted so as to dispense an article in exchange with a bill, can give a purchaser an expectation and stimulation through tactile and auditory sense as in the case of a coin-operated capsuled article vending machine.

According to another aspect of the invention, the locking mechanism is provided with a cam plate attached to the handle and a solenoid located in the capsule dispensing unit, and the control unit activates an iron core of the solenoid to move back and forth toward a recess formed on the cam plate, in order to lock or unlock a forward rotational motion of the handle. The locking mechanism is provided with a cam plate attached to the handle and a solenoid located in the capsule dispensing unit, and is constituted in such a manner that an iron core of the solenoid is activated by the control unit to move back and forth toward a recess formed on the cam plate, in order to lock or unlock a forward rotational motion of the handle. Under such configuration, since the sensor detecting a rotational motion of the handle causes a mechanical action of engaging the iron core of the solenoid with the cam plate rotating in synchronization with the handle, to thereby directly lock or unlock the handle for dispensing an article, exactly one piece of merchandise can be dispensed, thus eliminating erroneous operation.

According to another aspect of the invention, the sensor detects a rotational motion of the handle based on detection of the recess. Since the sensor detects a rotational motion of the handle based on detection of the recess, the iron core of the solenoid can be driven at an accurate timing, and an unnecessary factor can be eliminated.

According to another aspect of the invention, the sensor comprises a first sensor for detecting a start of the handle rotation upon detecting an arrival of the recess and a second sensor for detecting a completion of the handle rotation upon detecting an arrival of the recess, and the control unit locks the handle when the second sensor detects an arrival of the recess after the first sensor has detected the recess. Since the sensor comprises a first sensor for detecting a start of the handle rotation upon detecting an arrival of the recess and a second sensor for detecting a completion of the handle rotation upon detecting an arrival of the recess and the control unit locks the handle when the second sensor detects an arrival of the recess after the first sensor has detected the recess, erroneous operation of the solenoid can be prevented even when the second sensor is activated owing to a play in the reverse rotation preventing mechanism, and resultantly the merchandise can be properly dispensed.

According to another aspect of the invention, an angle θ1 of the recess of the cam plate is greater than an angle θ2 formed by a rear end portion of the recess in a locked state and a position where the second sensor detects the recess. Therefore, the iron core of the solenoid does not fail to be driven forward toward inside the recess when the second sensor detects the recess, which surely prevents an erroneous operation such as repeated rotation of the handle and the like.

DESCRIPTION OF THE PREFERRED EMBODIMENTS

Now referring to the accompanying drawings, an embodiment of the capsuled article vending machine according to the present invention shall be described hereunder.

Figure 1:
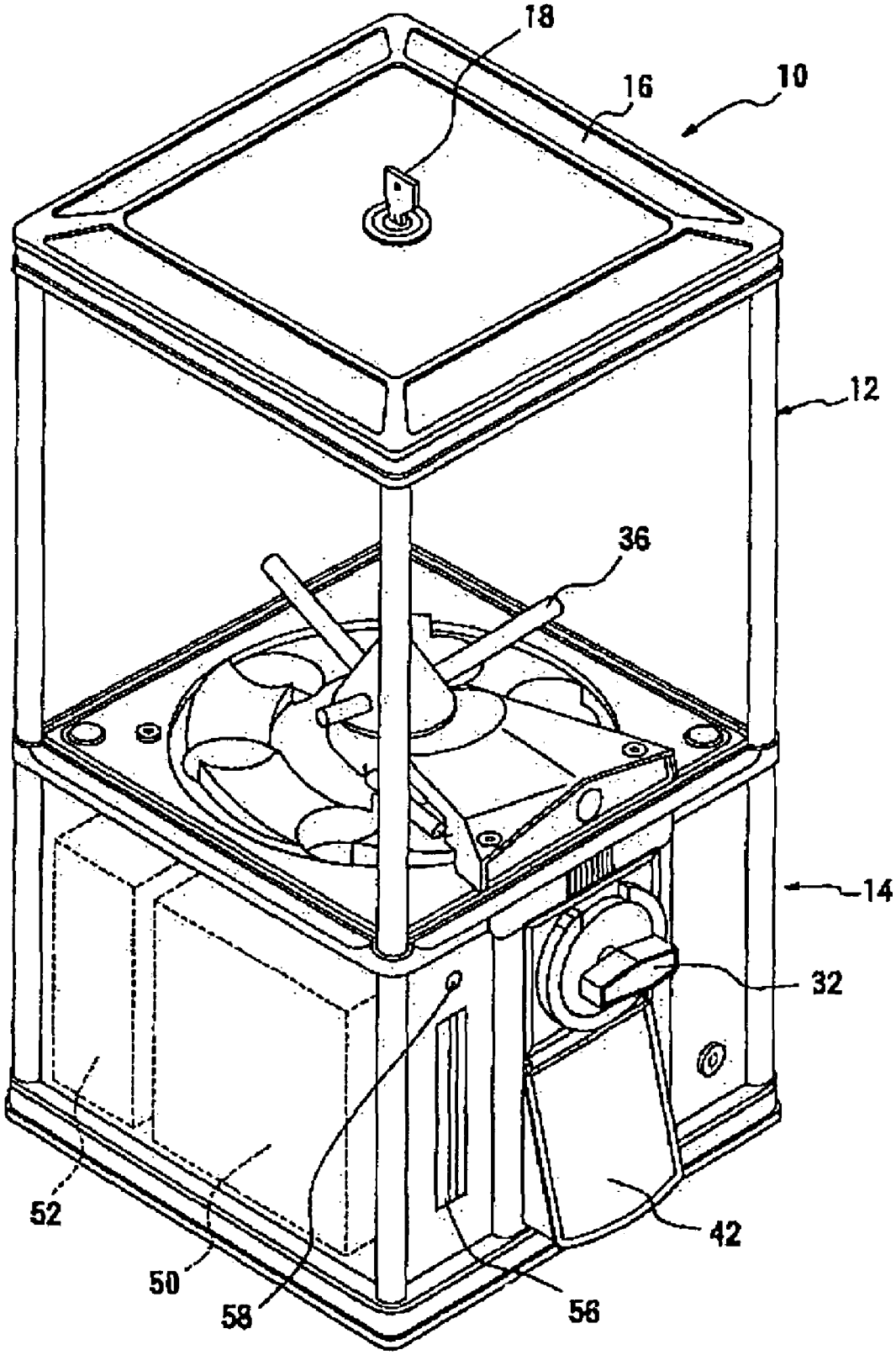
FIG. 1 is a perspective view showing a capsuled article vending machine according to the present invention.

FIG. 1 is a perspective view showing the entire capsuled article vending machine.

The capsuled article vending machine 10 is provided with a capsule container 12 at an upper portion thereof and a capsule dispensing unit 14 at a lower portion thereof.

The capsule container 12 constitutes a merchandise showcase having four vertical panels, out of which three except a back panel, or all four are clear panels. A top cover 16 is provided at an uppermost end portion of the capsule container 12. The top cover 16 can be opened or locked with a key 18. A number of clear spherical capsules, which are not shown though, are to be stored in the capsule container 12. Either an article itself or a ticket for exchanging with an article is enclosed in the respective capsules.

Figure 2:
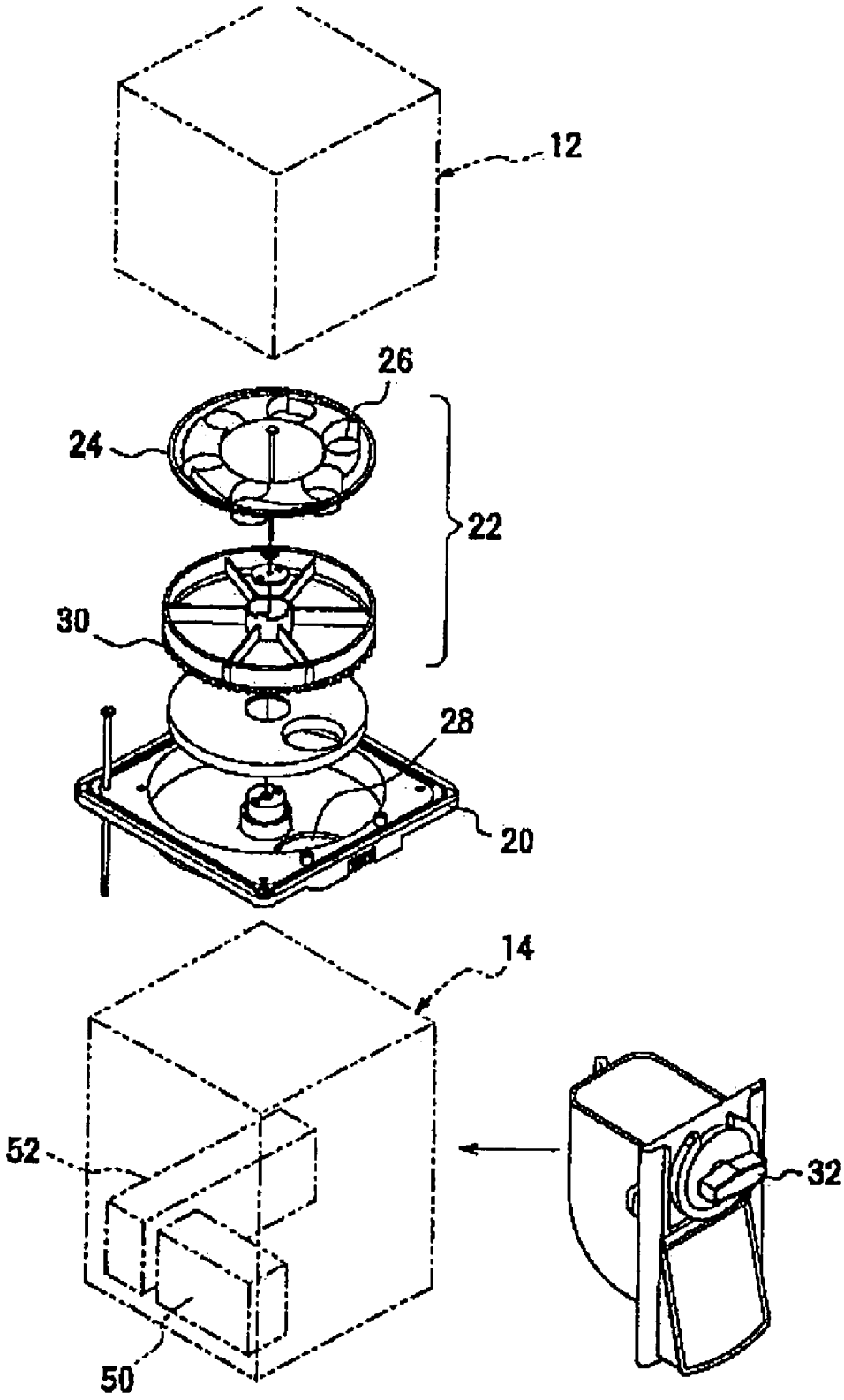
FIG. 2 is an exploded perspective view showing a turntable unit of the capsuled article vending machine.

The capsule dispensing unit 14 serves to dispense a capsule out of the capsule container 12. The capsule dispensing unit 14 is provided with a turntable unit 22 mounted on a hopper 20 placed at a bottom portion of the capsule container 12, as shown in FIG. 2.

A turntable 24 on the turntable unit 22 is provided with openings 26 at intervals of 60 degrees, into which one of the capsules is to get caught. The turntable unit 22 may be constituted in different ways depending on a shape and size of the capsule, and may for example have the openings 26 for capturing the capsule at every 90 degrees.

When the turntable unit 22 rotates, one of the capsules falls into one of the openings 26, which is to be aligned with a through hole 28 provided on the hopper 20.

The turntable unit 22 is provided with a bevel gear 30. A handle frame 31 is attached to a front wall of the capsuled article vending machine 10. A handle 32 is rotatably mounted on the handle frame 31. Rotation of the handle 32 is transmitted to the turntable unit 22 from a pinion gear 34 fixed to the handle 32 through the bevel gear 30. One rotation of the handle causes a linked rotational motion of the turntable unit 22 by 60 degrees or 90 degrees. Also, the turntable unit 22 is provided with a sweeping bar 36 for driving the capsules in the capsule container 12 into the openings 26.

Figure 3:
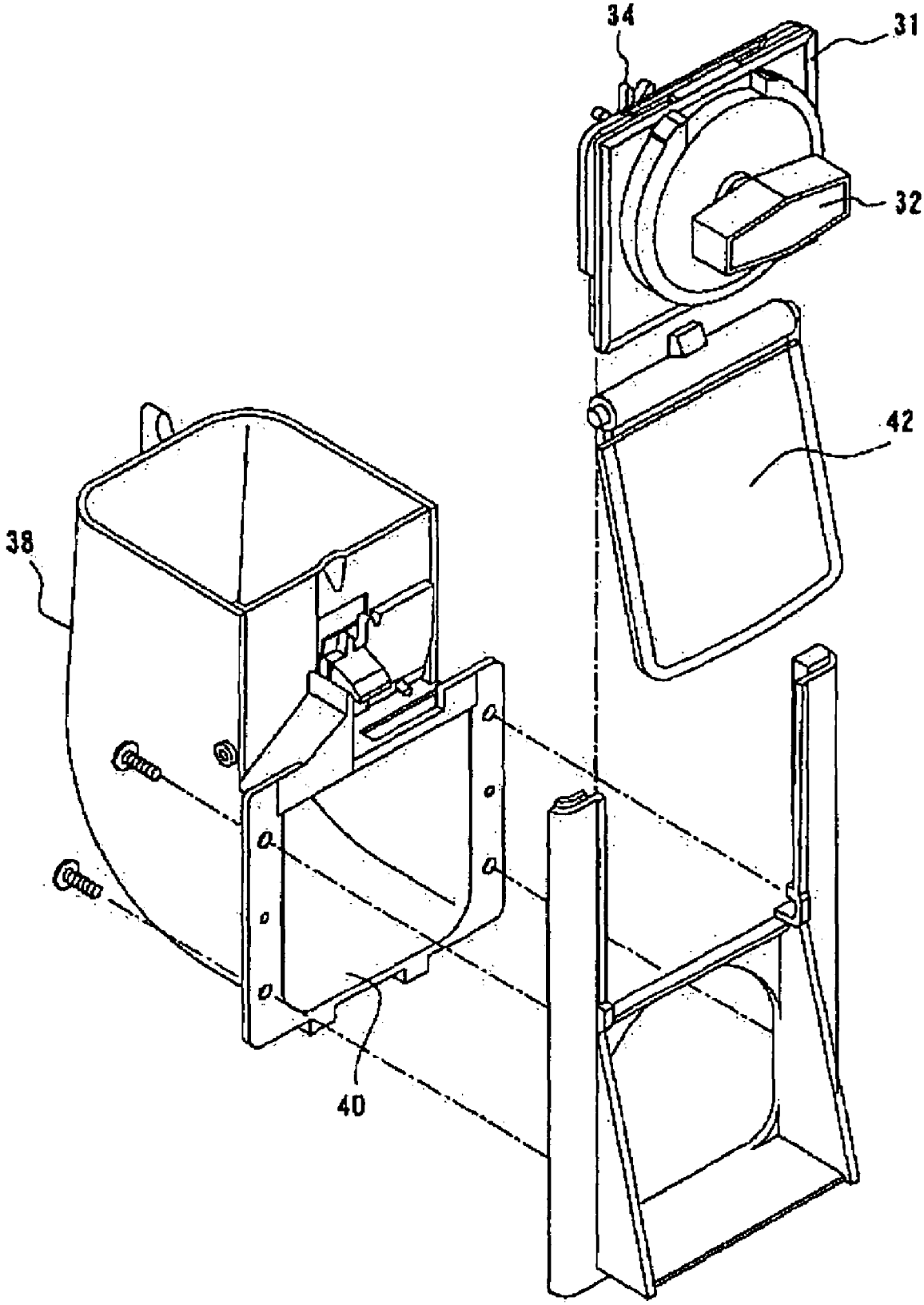
FIG. 3 is an exploded perspective view showing a capsule dispensing unit of the capsuled article vending machine.

The capsule that has passed through the through hole 28 of the hopper 20 is led to an outlet 40 through a J-shaped chute 38 as shown in FIG. 3. The outlet 40 is provided with a cover 42 with its upper edge supported by a hinge. It is unknown to a purchaser which of the merchandise comes out, until he or she opens the cover 42.

Figure 4:
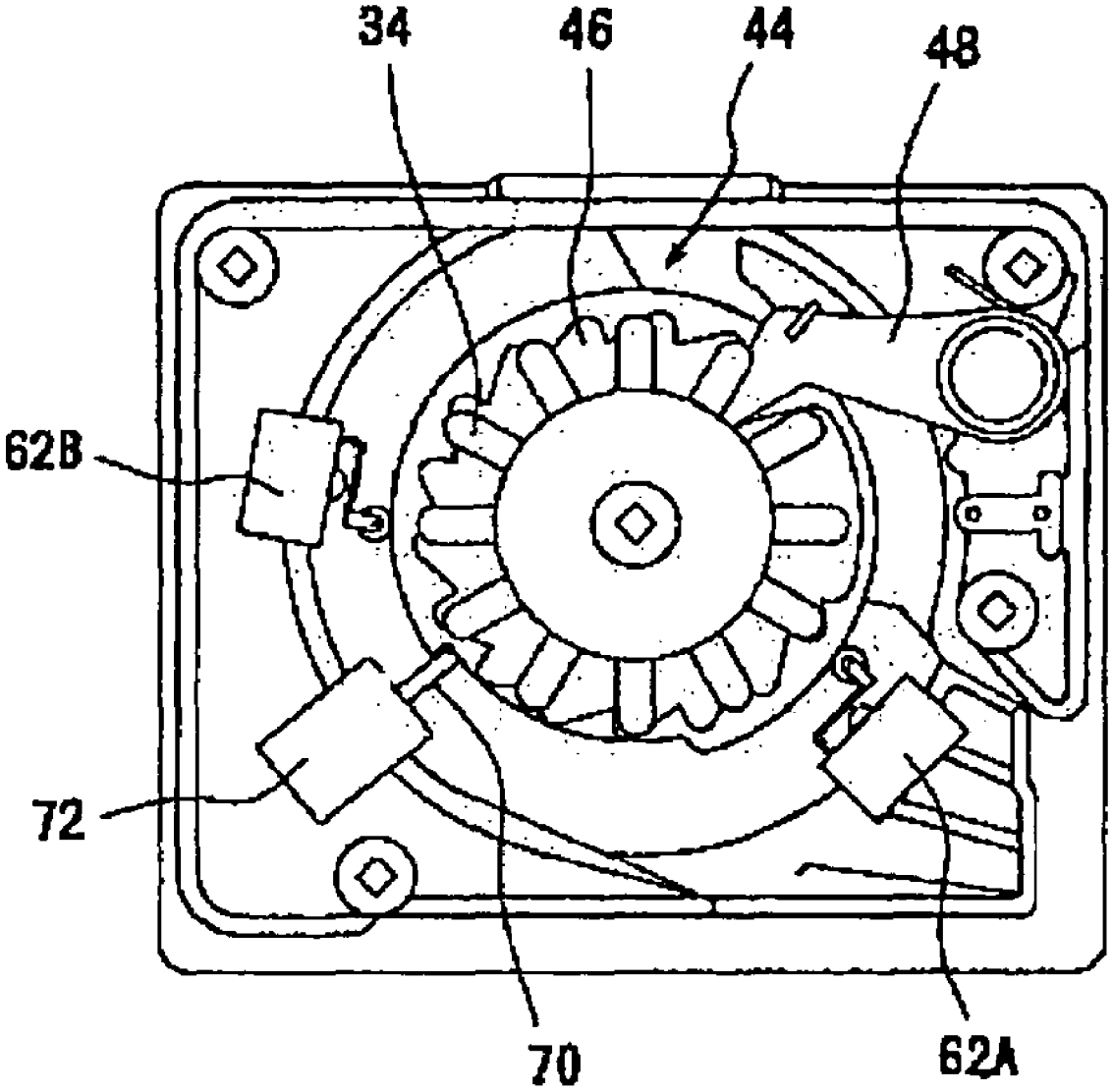
FIG. 4 is a perspective view showing a handle frame of the capsuled article vending machine viewed from a back of the handle.

The capsule dispensing unit 14 is provided with a reverse rotation preventing mechanism 44 of the handle 32, in addition to the handle 32. As shown in FIG. 4, the reverse rotation preventing mechanism 44 is provided with ratchet teeth 46 attached to the handle 32 and a ratchet 48 engaged with the ratchet teeth 46. The ratchet teeth 46 are fixed to the handle 32 inside the capsuled article vending machine 10 for performing synchronized rotation with the handle 32. The ratchet 48 has its tip portion energized toward a center of the ratchet teeth 46, to remain constantly engaged with the ratchet teeth 46. Once a tooth of the ratchet teeth 46 passes over the ratchet 48, the ratchet teeth 46 can no longer rotate in a reverse direction. At this moment, the reverse rotation preventing mechanism produces a metallic clicking sound that stimulates an auditory sense of the purchaser.

The capsule dispensing unit 14 of the capsuled article vending machine 10 according to the invention, which has been designed for operation with a monetary bill, is provided with a bill identifying unit 50, a bill storing box 52 and a rotation control unit 54 for the handle 32 as shown in FIGS. 1 and 2. Also, a bill slot 56 and an LED 58 are provided by the side of the handle 32 on the front face of the capsuled article vending machine 10. Here, the bill slot 56 and the LED 58 may be disposed at a different position such as on a lateral wall of the capsuled article vending machine 10.

The bill identifying unit 50 decides whether a bill inserted through the bill slot 56 is an authentic one or not. Then a signal indicating the authenticity of the bill and a signal indicating a value and a number of the bills are transmitted to the rotation control unit 54. The bill that has passed through the bill identifying unit 50 is transferred to the bill storing box 52.

The bill identifying unit 50 and the bill storing box 52 are placed inside the capsuled article vending machine 10.

The rotation control unit 54 is provided with a locking mechanism 60 for locking or unlocking the handle 32, sensors 62A and 62B for detecting a rotational position or a rotational angle of the handle 32 and a control unit 64 for controlling the locking mechanism 60 and the sensors 62A and 62B.

As shown in details in FIG*s*. 4, 7, 8 and 9, the locking mechanism 60 of this embodiment is provided with a cam plate having a recess 66 and with a solenoid 72 having an iron core 70 that can be moved back and forth.

The cam plate 68 is attached to the handle 32 inside the capsuled article vending machine 10, so as to rotate in synchronization with the handle 32. The solenoid 72 is mounted on the handle frame 31 supporting the handle 32, inside the capsuled article vending machine 10. The iron core 70 of the solenoid 72 moves forward along a direction of a normal of the cam plate 68 under an exited state, and moves backward along a direction of the normal of the cam plate 68 in a non-exited state.

The recess 66 of the cam plate 68 is formed by cutting away a portion of a circumferential surface of the cam plate 68 over a phase angle θ1, which is approx. 90 degrees. The recess 66 is constituted of a slope portion 74, an arc-shaped bottom face 76 having a diameter that is smaller than that of the cam plate 68 and a stopper portion 78 in a direction of a normal of the cam plate 68, along a rotating direction of the handle 32.

A tip portion of the iron core 70 of the solenoid 72 enters into the recess 66 when the iron core 70 moves forward. When the iron core 70 is in the recess 66, a locked state is established. The tip portion of the iron core 70 of the solenoid 72 is separated from a circumferential surface of the cam plate 68 when the iron core 70 moves backward. When the iron core 70 is separated from the circumferential surface of the cam plate 68, the locking state is released.

Under the locked state, the handle 32 is kept from rotating in a direction to dispense a capsule (a forward direction) by the rotation control unit 54. Meanwhile, reverse rotation of the handle 32 is prevented by the reverse rotation preventing mechanism 44.

When the locking state is released, the handle 32 can freely rotate in a direction to dispense a capsule (a forward direction). However reverse rotation of the handle 32 is still prevented by the reverse rotation preventing mechanism 44.

Also, the locking mechanism may be constituted in different ways, such as forming an arc-shaped recess or an arc-shaped through hole extending along a circumferential surface. In such cases the iron core 70 of the solenoid 72 is to move back and forth along an axial direction of the cam plate 68 to get engaged or disengaged with the recess or the through hole, thereby locking or unlocking the handle 32.

However, taking into account the availability of a space for mounting the solenoid 72, it is preferable to arrange so as to move the iron core 70 of the solenoid 72 back and forth along a direction of a normal, i.e. a radial direction of the cam plate 68 as shown in FIG. 4, since the pinion gear 34, capsule dispensing chute 36, the ratchet 46, etc. are located in the proximity of a back side of the handle 32.

In this embodiment, the sensor is constituted of a first sensor 62A and a second sensor 62B. The respective sensors 62A, 62B detect a rotational position or a rotational angle of the cam plate 68, i.e. a rotational position or a rotational angle of the handle 32, by detecting an arrival of the recess 66. Otherwise it is also possible to provide a projection on the cam plate 68 so that a sensor detects the rotational position upon detecting the projection, or to detect the rotational angle by counting a number of teeth of the pinion gear 34 or the ratchet teeth 46, in order to detect the rotational position or the rotational angle of the cam plate 68 i.e. of the handle 32. However, from a viewpoint of the arrangement of components and mechanism within a limited space, utilizing the recess 66 for locking and unlocking the handle 32 for the detection of the rotational position of the cam plate 68 is more advantageous since a number of components can be reduced and the overall structure can thereby be simplified.

A principal function of the first sensor 62A is to detect a start of a rotation of the handle 32. Accordingly, a phase angle between the solenoid 72 and the first sensor 62A is greater than the phase angle θ1 of the recess 66. With a capsuled article vending machine of a similar type, a purchaser usually rotates the handle 32 twice, by approx. 180 degrees each time. Therefore, it is preferable to dispose the first sensor 62A within 180 degrees from an end portion of the recess 66, in order to detect a start of the handle rotation at the first rotating action of 180 degrees by the purchaser. In this embodiment, the first sensor 62A detects an arrival of the recess 66 at approx. 60 degrees from the end portion of the recess 66. A signal emitted by the first sensor 62A is transmitted to the control unit 64.

The second sensor 62B is provided mainly for detecting that one rotation of the handle 32 is about to be completed, so that the handle 32 is kept from rotating any further once one rotation is completed. For such purpose, a phase angle θ2 between the solenoid 72 and the second sensor 62B is smaller than the phase angle θ1 of the recess 66. When the second sensor 62B detects an arrival of the recess 66 the iron core 70 moves forward toward a bottom face of the recess 66, by which an additional rotation of the handle 32 is prevented after one rotation is completed. A signal emitted by the second sensor 62B is transmitted to the control unit 64, as the case of the first sensor 62A.

Also, the first sensor 62A and the second sensor 62B serve to detect a position of the handle 32 at which a bill can be inserted.

Figure 5:
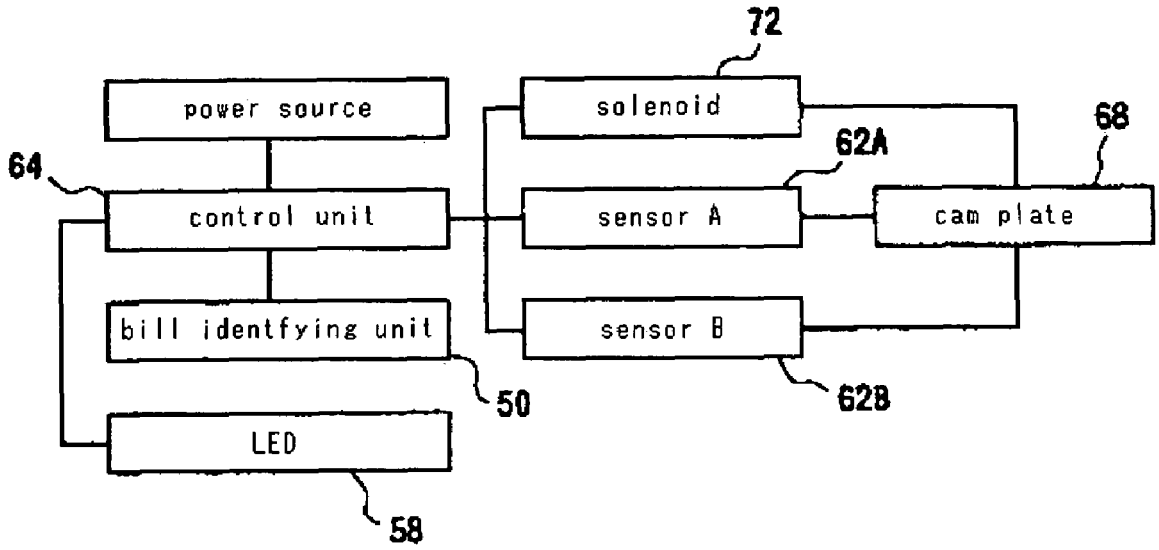
FIG. 5 is a block diagram showing a constitution of the capsuled article vending machine including a control unit.
Figure 6:
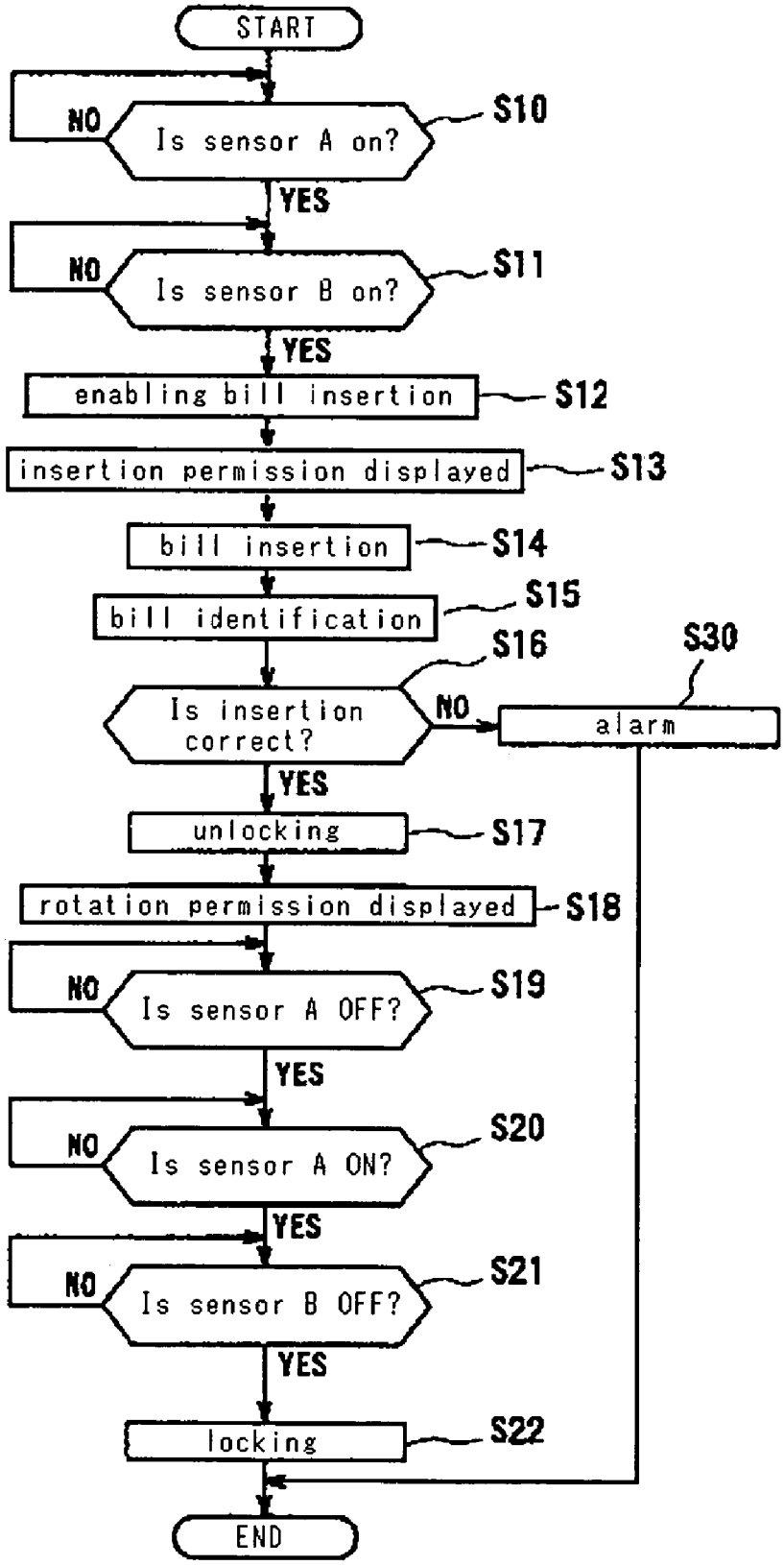
FIG. 6 is a flowchart showing operating process of the control unit.

FIG. 5 is a block diagram showing a control system of the capsuled article vending machine 10; FIG. 6 is a flowchart showing operating process of the control unit 64; and FIGS. 7 through 10 are explanatory drawings of operation of the locking mechanism 60, the first sensor 62A and the second sensor 62B. The control unit 64 receives a signal from the bill identifying unit 50, to control the locking mechanism 60, the first sensor 62A and the second sensor 62B based on the signal. Operation of the capsuled article vending machine 10 shall now be described hereunder referring to FIGS. 5 through 10.

Figure 7:
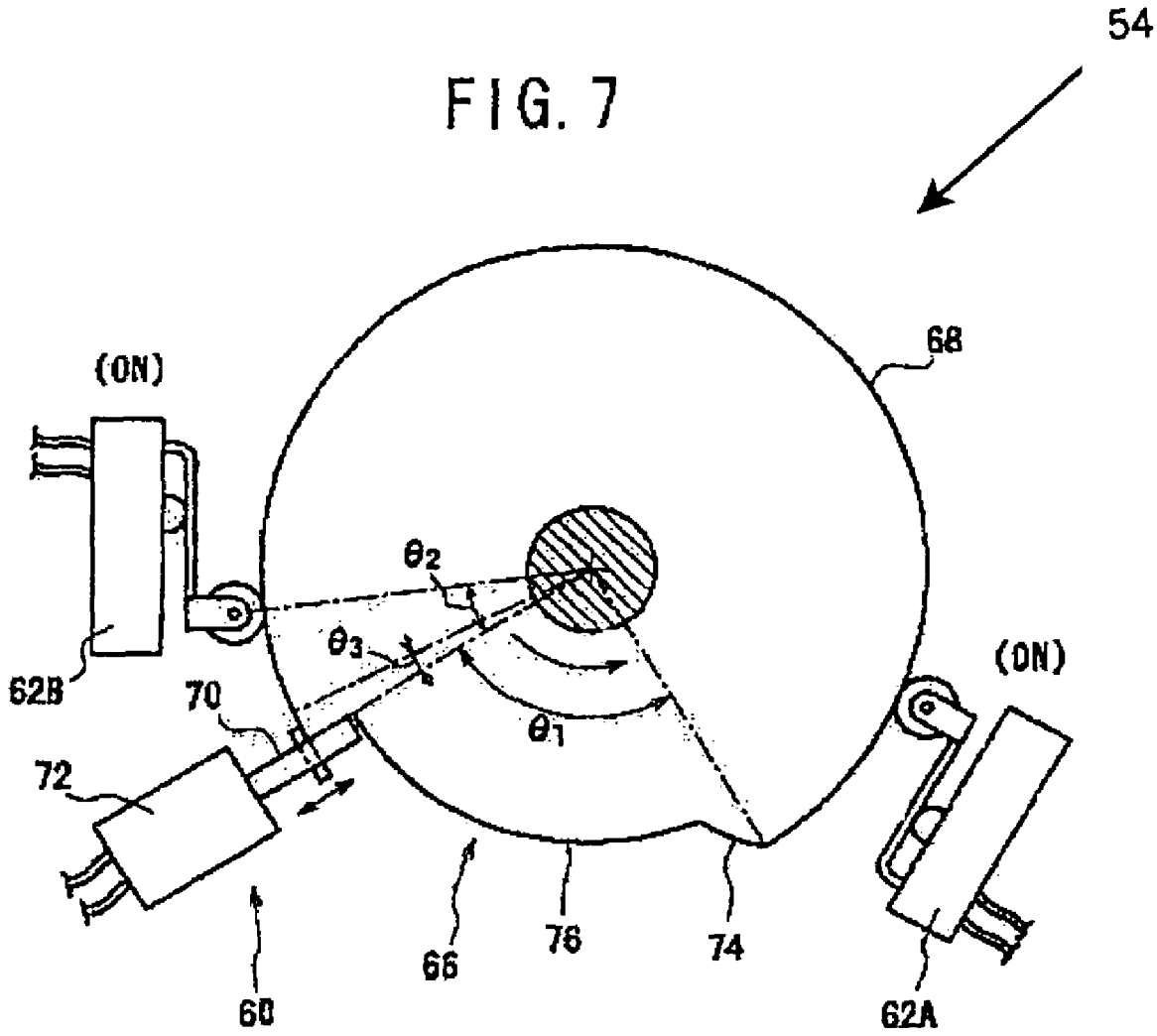
FIG. 7 is an explanatory drawing of operation of a rotation control unit of the capsuled article vending machine.

When the handle 32 is at its initial position, the iron core 70 of the solenoid 72 is inside the recess 66 of the cam plate 68 and adjacent to the stopper portion 78, as shown in FIGS. 1, 4 and 7. The iron core 70 is spaced from the bottom face 76, i.e. not interfering with the bottom face 76. The first sensor 62A and the second sensor 62B are in contact with a circumferential surface of the cam plate 68, and are tuned ON respectively.

The handle 32 and the cam plate 68, despite being prevented from rotating in a reverse direction by the reverse rotation preventing mechanism 44, can slightly rotate by an angle θ3 because of a play of the ratchet teeth 46 and the ratchet 48. The phase angle θ2 between the solenoid 72 and the second sensor 62B is sufficiently greater than the play angle θ3, so that the second sensor 62B does not detect the recess 66 owing to the play of the reverse rotation preventing mechanism 44. In order to avoid an erroneous detection because of the play, it is desirable that the phase angle θ2 is as large as possible. However, in case where the phase angle θ2 becomes greater than the phase angle θ1 of the recess 66 the iron core 70 interferes with the cam plate 68. Therefore, it is preferable to set the respective phase angles so as to satisfy a condition of θ1>θ2>θ3.

The control unit 64 enables insertion of a bill (the step S12) provided that the first sensor 62A and the second sensor 62B are ON (S10, S11). At this stage, the control unit 64 either activates the LED 58 located at the front face of the capsuled article vending machine 10, or causes the LED 58 to emit a prescribed color (S13).

A purchaser inserts a bill through the bill slot 56 located at the front face of the capsuled article vending machine 10 (S14). A value and a number of the bill to be inserted vary depending on prepared merchandise. The bill identifying unit 50 identifies the value and the number of the inserted bills, and emits a signal indicating the value and the number of the bills to the control unit 64 (S15). The control unit 64 examines the inserted bill (S16). In case where the bill should prove to be a forged one, for example an alarm sound is activated (S30).

Once the bill has proved to be authentic and a sum of the bill reaches a predetermined amount, the control unit 64 causes the iron core 70 of the solenoid 72 to move backward (S17).

Figure 8:
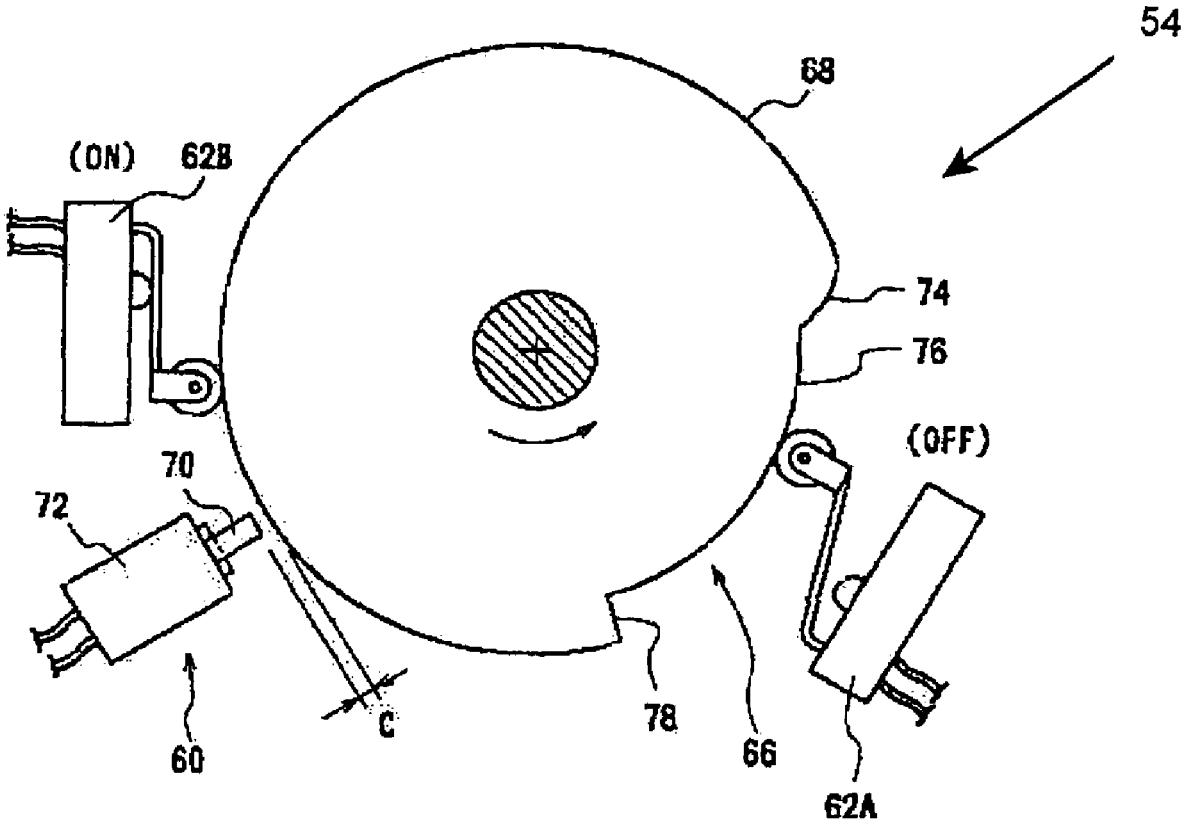
FIG. 8 is an explanatory drawing of operation of the rotation control unit.
Figure 9:
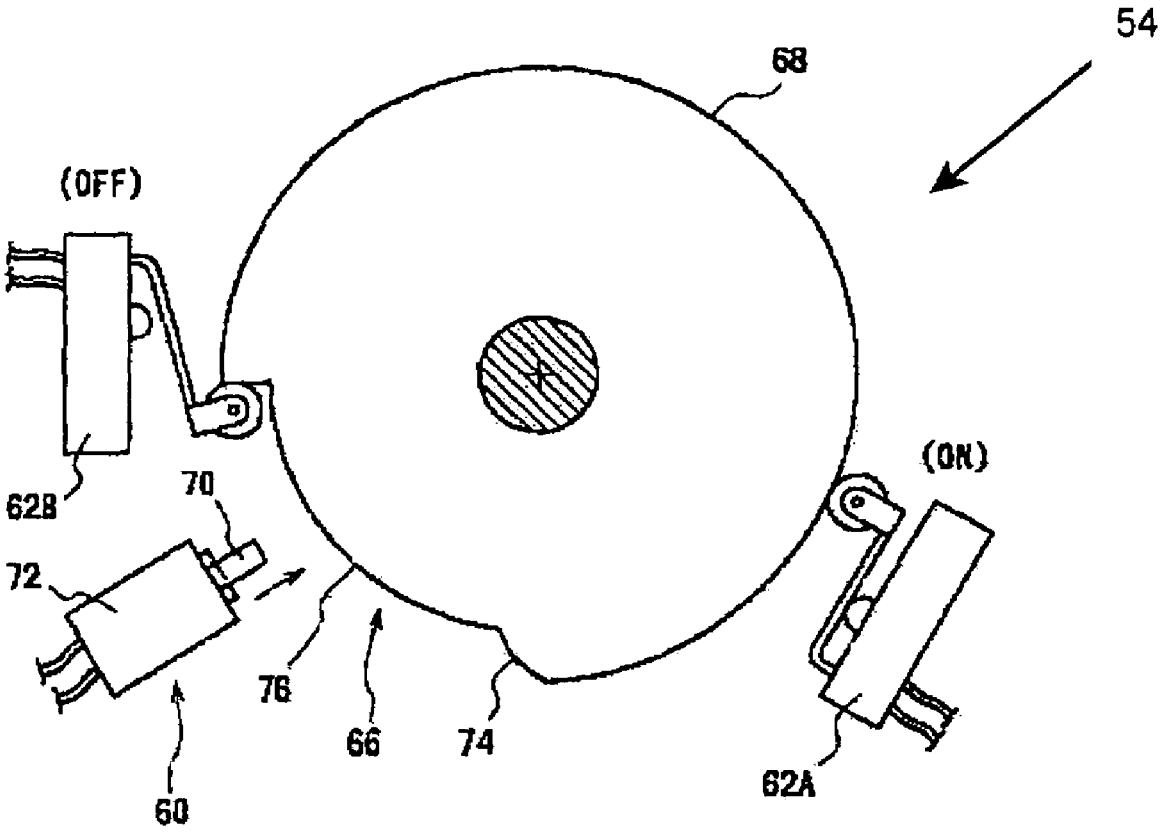
FIG. 9 is an explanatory drawing of operation of the rotation control unit.

As shown in FIG. 8, the iron core 70 is separated from a circumferential surface of the cam plate 68 by a gap c. At this stage, the control unit 64 causes the LED 58 to emit a prescribed color, thereby visually granting the purchaser a permission to rotate the handle 32 (S18).

While the purchaser is rotating the handle 32 in a forward direction the reverse rotation preventing mechanism 44 produces a metallic clicking sound each time a tooth of the ratchet teeth 46 passes over the ratchet 48, to stimulate the auditory sense of the purchaser. Also, vibration caused when the ratchet teeth 46 pass over the ratchet 48 stimulates the tactile sense of the purchaser.

When the handle 32 and the cam plate 68 have rotated by a certain angle, the first sensor 62A detects the recess 66 and becomes OFF. With a successive rotation thereafter, the first sensor 62A returns to the ON state. The control unit 64 recognizes the transition of ON-OFF-ON of the first sensor 62A (S19, S20). These steps assure that the handle 32 is correctly operated, and securely prevents a malfunction that the handle 32 cannot rotate because of the play of the reverse rotation preventing mechanism 44.

The steps up to the stage where the first sensor 62A detects the recess 66 is terminated upon completion of the first rotating action of 180 degrees performed by the purchaser.

With the second rotating action of the handle 32 by the purchaser, the iron core 70 of the solenoid 72 enters into a range of the phase angle of the recess 66 after the second sensor 62B becomes OFF upon detecting an arrival of the recess 66 (S21), the control unit 64 causes the iron core 70 to move forward toward the recess 66 (S22).

As a result of forming the recess 66 with a certain phase angle θ1, as well as of setting a sufficient range of phase angle θ2 between the solenoid 72 and the second sensor 62B, a sufficient time is secured for the iron core 70 to achieve a forward movement within a range of the recess 66. Therefore, even when the rotation of the handle 32 over the latter 180 degrees is quickly performed, the iron core 70 of the solenoid 72 can be caused to complete the motion to securely achieve a contact with the stopper portion 78.

It is to be understood that the foregoing embodiment has been disclosed only for illustrative purpose rather than for limiting the invention, with a true scope and spirit of the invention being indicated by the appended claims.

The invention claimed is:

1. A capsuled article vending machine having a capsule container and a capsule dispensing unit for dispensing a capsule out of the capsule container through the capsule dispensing unit each time a handle is rotated by one rotation, said capsuled article vending machine, comprising:

a bill identifying unit for receiving and identifying paper currency and providing a signal when paper currency received by the bill identifying unit is determined to be valid and of a predetermined value;

a rotation control unit, responsive to said signal provided by the bill-identifying unit, for enabling one rotation of the handle after said signal is provided by the bill identifying unit;

a mechanism for preventing reverse rotation of the handle said reverse rotation preventing mechanism comprising ratchet teeth that rotate in synchronization with the handle and a pawl engaged with the ratchet teeth for preventing reverse rotation of the handle, said ratchet teeth being of sufficient size that impact of the pawl with the ratchet teeth as the handle is rotated can be both heard and felt by an individual rotating the handle;

a handle locking mechanism comprising a cam plate having a recess and a solenoid having an armature that can be moved into and out of the recess of the cam plate for locking the handle in a locking position;

wherein said rotation control unit causes the armature of the solenoid to move out of the recess in order to permit forward rotation of the handle when the bill identifying unit has provided a validation signal;

a first sensor for detecting a start of the handle rotation upon detecting arrival of the recess into proximity with the first sensor, and a second sensor for detecting completion of the handle rotation upon detecting arrival of the recess into proximity with the second sensor, and wherein the control unit is responsive to said sensors to cause the armature of the solenoid to lock the handle against rotation when the second sensor detects arrival of the recess into proximity with the second sensor after the first sensor has detected the arrival of the recess into proximity with the first sensor; and wherein an angle θ1 subtended by the recess of the cam plate is greater than an angle θ2 subtended by a portion of the cam plate extending from a rear end of the recess when the cam plate is locked by said armature to the position at which the second sensor detects the recess, and wherein the angle θ2, subtended by a portion of the cam plate extending from a rear end of the recess when the cam plate is locked by said armature to the position at which the second sensor detects the recess, is greater than the play angle θ3 of the reverse rotation preventing mechanism.

2. The capsuled article vending machine according to claim 1, wherein both sensors are positioned to detect proximity of the recess in said cam plate, whereby the sensors detect rotational motion of the handle based on detection of the recess.

* * * * *